US005095636A

United States Patent [19]

Arnold

[11] Patent Number: 5,095,636

[45] Date of Patent: * Mar. 17, 1992

[54] FABRIC COVER MARKING DEVICE AND METHOD

[76] Inventor: Dorothy Arnold, 4094 Frances Dr., Delray Beach, Fla. 33445

[*] Notice: The portion of the term of this patent subsequent to Aug. 27, 2008 has been disclaimed.

[21] Appl. No.: 705,520

[22] Filed: May 24, 1991

Related U.S. Application Data

[63] Continuation-in-part of Ser. No. 497,114, Mar. 21, 1990, Pat. No. 5,042,166.

[51] Int. Cl.[5] ..... G01D 21/00

[52] U.S. Cl. ..... 33/644; 33/669; 33/578; 114/361

[58] Field of Search ..... 33/644, 622, 666, 669, 33/679, 677, 574, 575, 576, 578, DIG. 10; 114/361

[56] References Cited

U.S. PATENT DOCUMENTS

| | | | |
|---|---|---|---|
| 1,645,499 | 10/1927 | Fenton . | |
| 1,647,962 | 11/1927 | Fenton . | |
| 1,778,677 | 10/1930 | King . | |
| 1,787,143 | 12/1930 | Clark et al. . | |
| 2,257,787 | 10/1941 | Cohen . | |
| 2,638,682 | 5/1953 | Russell | 33/574 |
| 2,659,983 | 11/1953 | Zore | 33/578 |
| 2,666,546 | 1/1954 | Reilly | 33/DIG. 10 |
| 2,721,393 | 10/1955 | Frisbee | 33/574 |
| 2,889,839 | 6/1959 | Sheridan, Jr. | 114/361 |
| 2,961,725 | 11/1960 | McGee . | |
| 3,088,295 | 5/1963 | Haines . | |
| 3,202,193 | 8/1965 | Ware . | |
| 3,203,105 | 8/1965 | Whistler et al. | 33/578 |
| 3,924,331 | 12/1975 | Goosen | 33/DIG. 10 |
| 3,940,857 | 3/1976 | Giordano | 33/DIG. 10 |
| 4,059,905 | 11/1977 | Wieting | 33/DIG. 10 |
| 4,359,302 | 11/1982 | Payne | 33/DIG. 10 |
| 4,466,374 | 8/1984 | Katz | 114/361 |
| 4,507,344 | 3/1985 | Baughman . | |

*Primary Examiner*—Thomas B. Will

*Attorney, Agent, or Firm*—Fay, Sharpe, Beall, Fagan, Minnich & McKee

[57] ABSTRACT

A fabric cover marking device is for marking the location on a fabric cover for a female fastener portion engageable with a complementary male fastener portion mounted on a structure to be covered, for example a boat. The device comprises a socket portion and a pin portion. The socket portion is releasably engageable with the male fastener portion. The pin portion is mounted on the socket portion and is capable of piercing the fabric cover when the socket portion is engaged with the male fastener portion. Embodiments for releasable engagement with snap studs, lift-a-dot fastener studs, and turnbuckles are disclosed. The method for manufacturing a fabric cover for covering a structure having mounted thereon a plurality of male fastener portions to which the cover is to be fastened comprises the steps of securing onto each of the male fastener portions a marking device comprising a socket portion complementary to the male fastener portion and having a pin portion mounted thereon, disposing a fabric cover over the structure and over the marking devices secured to the male fastener portions, piercing the fabric cover with the pin portions of the marking device secured to the male fastener portions, marking the fabric cover at each of the locations where the fabric cover was pierced by one of the pin portions, and securing a female fastener portion to the fabric cover at each marked position.

9 Claims, 3 Drawing Sheets

FABRIC COVER MARKING DEVICE AND METHOD

RELATED APPLICATION

This application is a continuation-in-part of U.S. Patent application No. 497,114, filed Mar. 21, 1990, which issued as U.S. Pat. No. 5.042,166 on Aug. 27, 1991.

BACKGROUND OF THE INVENTION

The present invention relates to a fabric cover marking device and method. In particular, the present invention relates to a device used for marking the locations of the female portions of male/female securing devices on a boat cover or the like and to a method for manufacturing a fabric cover for attachment to complementary male portions of such securing devices mounted on a structure to be covered.

Fabric boat covers, such as those typically used to cover the cockpit area of a sail boat or cabin cruiser, normally are fastened in place by such male/female securing devices as snap fasteners, lift-a-dot fasteners, and turnbuckles. In the case of snap fasteners, female snap sockets are mounted to the cover, typically by riveting, in selected locations to be engageable with corresponding male snap studs that are threaded into the boat structure around the periphery of the cockpit opening. In the case of lift-a-dot fasteners, female lift-a-dot holes are riveted to the cover in locations to be engageable with male lift-a-dot studs threaded into the boat structure. Finally, in the case of turnbuckles, female slot-shaped grommets are secured to the cover in locations to be engageable with the male turnbuckles threaded into the boat structure.

The conventional method of making such covers uses spring-loaded clamps to secure canvas or plastic material to the male fastener portions, the studs or turnbuckles. The areas around the clamps then are marked. Finally, the cover material is taken back to the upholsterer's shop, where female fastener portions, the snap sockets, lift-a-dot holes, or grommets, are secured to the material at the marked locations.

The step of marking the fabric with the locations of the female fastener portions is particularly time consuming, due mostly to the nature of the clamps used. The clamps typically used are quite heavy and unwieldy and often have to be resecured several times before the entire cover is clamped down. Moreover, the clamps frequently disengage from the studs or turnbuckles and fall off into the water, entailing further delay and occasional loss of the clamps, which are expensive to replace.

The present invention is intended to provide a fabric cover marking device that will reliably secure the fabric to the male fastener portions and facilitate the marking of the locations of the female fastener portions.

The present invention also is intended to provide a fabric cover marking device that is relatively inexpensive and that reduces the time needed to mark the locations of the female fastener portions.

In addition, the present invention is intended to provide an improved method of manufacturing a fabric cover to be attached to male fastener portions mounted on the structure to be covered.

Additional advantages of the present invention will be set forth in part in the description that follows, and in part will be obvious from that description or can be learned by practice of the invention. The advantages of the invention can be realized and obtained by the apparatus and method particularly pointed out in the appended claims.

SUMMARY OF THE INVENTION

The present invention overcomes the problems of prior art fabric cover marking devices and methods by providing a marking device that can be secured directly to male fastener portions mounted on the structure to be covered. The marking device includes a pin portion that can pierce the fabric and hold it in place while the desired position of the female fastener portion is marked.

To overcome the problems of the prior art fabric cover marking devices, and in accordance with the purpose of the invention, as embodied and broadly described herein, the fabric cover marking device of this invention is for marking the location of a female fastener portion on a fabric cover, the female fastener portion being engageable with a male fastener portion mounted on a structure to be covered. The device comprises a socket portion and a pin portion. The socket portion is releasably engageable with the male fastener portion. The pin portion is mounted on the socket portion and is capable of marking the fabric cover by piercing the fabric cover when the socket portion is engaged with the male fastener portion.

Broadly, the method of the invention is for manufacturing a fabric cover for covering a structure having mounted thereon a plurality of male fastener portions to which the cover is to be fastened, which method comprises the steps of securing onto each of the male fastener portions a marking device comprising a socket portion complementary to the male fastener portion and having a pin portion mounted thereon, disposing a fabric cover over the structure and over the marking devices secured to the male fastener portions, piercing the fabric cover with the pin portions of the marking devices secured to the male fastener portions, and securing a female fastener portion to the fabric cover at each position where the fabric cover was pierced by one of the pin portions.

The accompanying drawings, which are incorporated in and which constitute a part of this specification, illustrate at least one embodiment of the invention and, together with the description, explain the principles of the invention.

DESCRIPTION OF THE PREFERRED EMBODIMENTS

Reference now will be made in detail to the presently preferred embodiments of the invention, examples of which are illustrated in the accompanying drawings.

Figure 1:
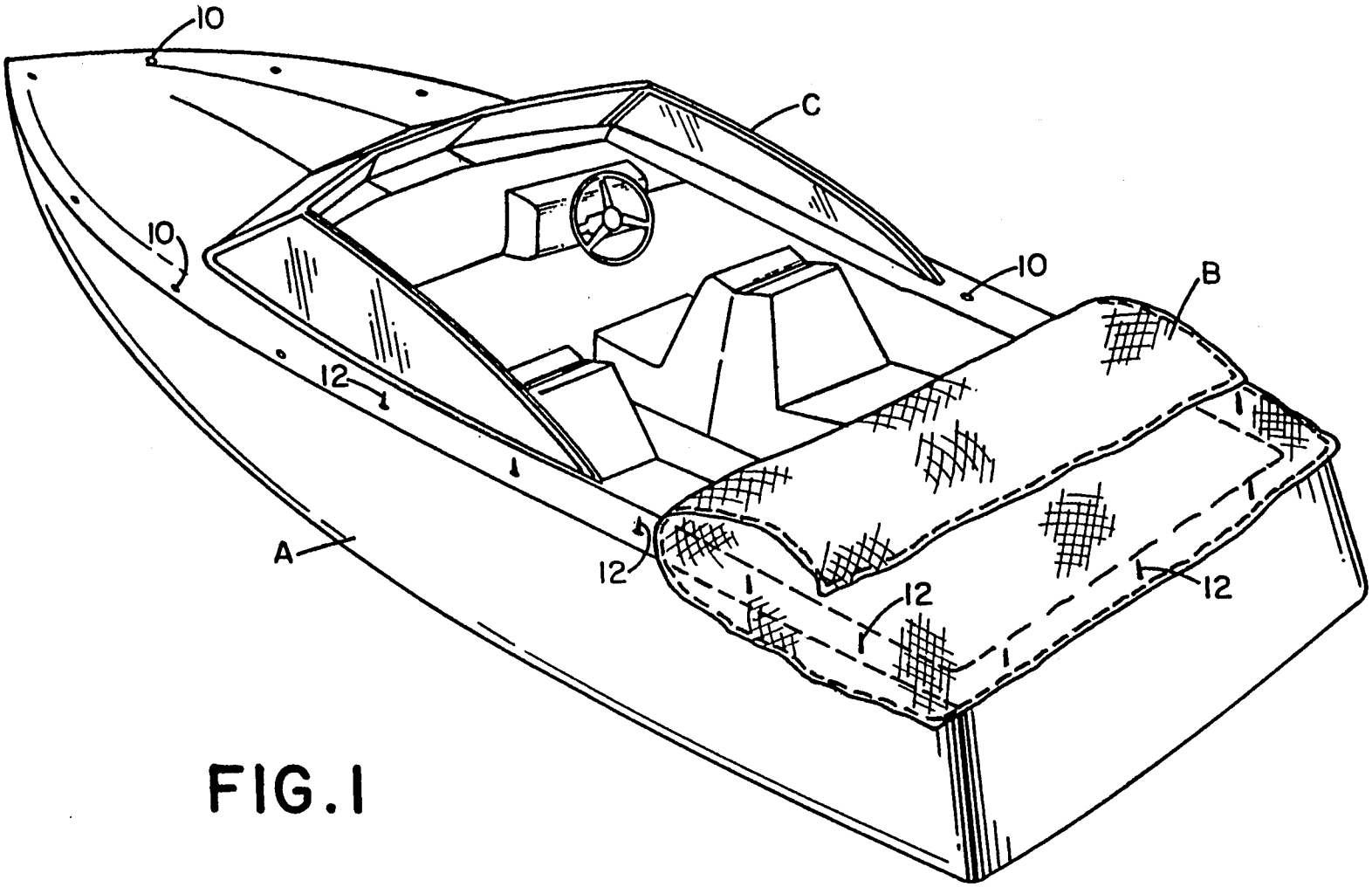
FIG. 1 is a perspective view of a boat illustrating how the fabric cover marking device of the present invention is used.

The present invention will be described with reference to a fabric cover for a motor boat. FIG. 1 illustrates motor boat A, which is to be covered with fabric cover B. A plurality of male fastener portions, for example snap studs 10, typically are mounted on the top deck of boat A. When finished, fabric cover B will include a plurality of female fastener portions, for example snap sockets engageable with snap studs 10, so that fabric cover B is removably secured to and covers boat A. As will be understood by those of ordinary skill in the art, snap studs 10 can alternatively be mounted on the upper edge of windshield assembly C of boat A, so that fabric cover B covers only the cockpit area.

Figure 3:
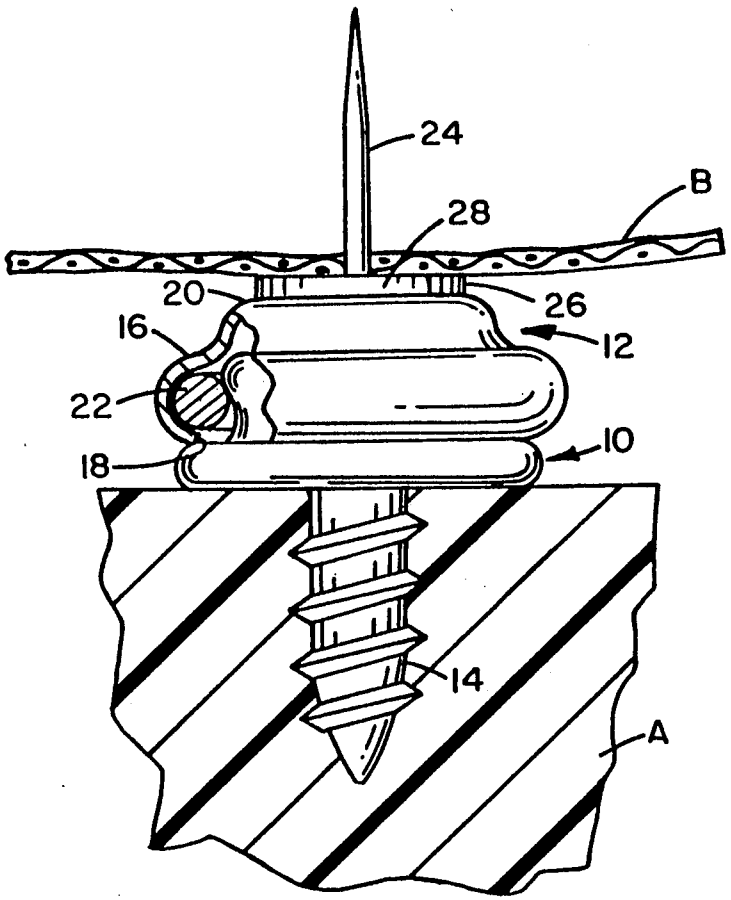
FIG. 3 is a partially cut away elevational view of the first embodiment of the fabric cover marking device of the present invention shown secured to a snap stud and engaging a fabric cover.
Figure 2:
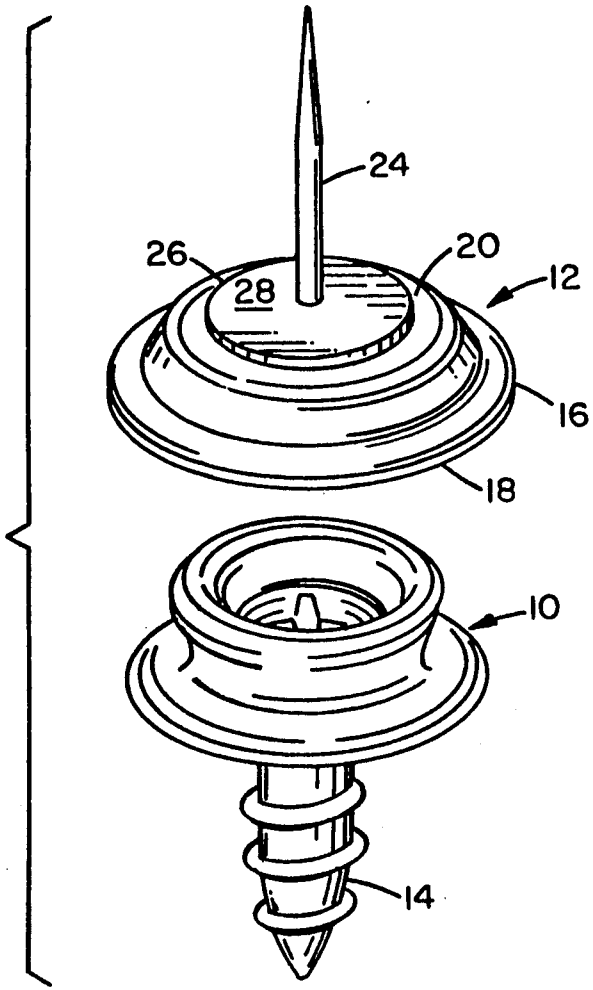
FIG. 2 is perspective view of one embodiment of the fabric cover marking device of present invention shown separated from a snap stud.

With reference to FIGS. 2 and 3, the firs&: embodiment of the present invention comprises a marking device, designated generally by reference numeral 12, that is used to mark the locations on fabric cover B corresponding to snap sockets that are to be removably secured to snap studs 10. Each snap stud 10 is secured to the top deck of boat A by threaded portion 14

In accordance with the invention, marking device 12 includes a socket portion 16 having a front side 18 and a rear side 20. Socket portion 16 preferably comprises a snap socket shaped and sized to fasten onto snap stud 10. In the embodiment shown in FIGS. 2 and 3, the snap socket comprising socket portion 16 includes snap ring 22, which snaps over the head portion of snap stud 10.

In accordance with the invention, marking device 12 also includes a pin portion 24 mounted on rear side 20 of socket portion 16. Pin portion 24 is capable of piercing fabric cover B when socket portion 16 is engaged with one of snap studs 10, as shown in FIGS. 1 and 3. In the first preferred embodiment shown in the drawings, pin portion 24 comprises the sharpened, elongated member of a tack, which is designated by reference numeral 26. Tack 26 includes a flat head portion 28, which is secured to rear side 20 of socket portion 16 by, for example, soldering.

The method of the present invention for manufacturing a fabric cover for covering a structure having mounted thereon a plurality of male fastener portions to which the cover is to be fastened now will be described in detail, with reference to the first embodiment of the marking device of the invention shown in FIGS. 1-3.

With reference to FIG. 1, the first step of the method of the invention is securing a marking device 12 onto each of the snap studs 10 on the structure to be covered. As shown in FIGS. 1 and 3, the pin portions 24 of marking devices 12 extend vertically upward from each snap stud 10. Next, fabric cover B is disposed over the top deck of boat A and pierced with the pin portions 24 of the marking devices 12 secured to the snap studs. Finally, a snap socket is secured to cover B at each position where the cover was pierced by one of the pin portions. The snap sockets preferably are secured to the cover by riveting.

For some fabrics, for example vinyl, the actual hole formed by the pin portion can be used as the location mark for riveting a snap socket to the fabric. As a general matter, however, it is preferable to mark the location of each pin portion with chalk or some other marking material while fabric B is secured to the marking devices to assist in locating the snap sockets on the fabric at the perforations provided by pin portions 24.

Figure 4:
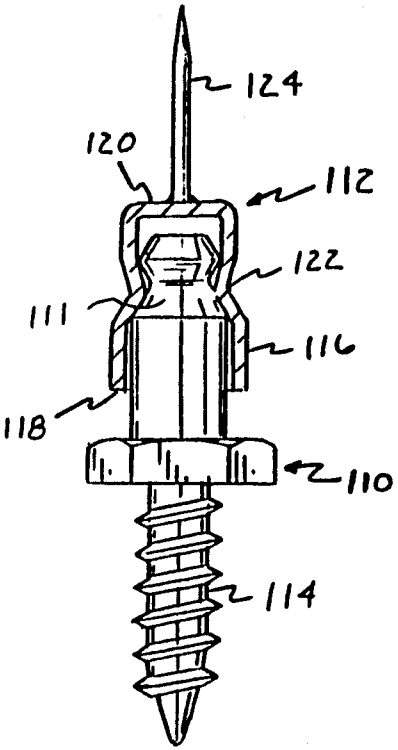
FIG. 4 is a partially cut away elevational view of a second embodiment of the fabric cover marking device of the present invention shown secured to a lift-a-dot fastener stud.

A second embodiment of the marking device of the present invention is shown in FIG. 4. It is intended to be used for covers that are secured to the boat or other structure by lift-a-dot fasteners. Specifically, the cover includes a plurality of female lift-a-dot holes that have a central opening that fits over lift-a-dot studs 110. The opening of each lift-a-dot hole includes a wire spring that deforms when passing over the head portion of stud 110 but springs back to engage the reduced diameter-section 111 of stud 110 and releasably secure the hole to the stud.

The second embodiment of the marking device, designated generally by reference numeral 112, is used to mark the locations on a fabric cover corresponding to the lift-a-dot holes that are to be removably secured to studs 110. Each lift-a-dot stud 110 is secured to the structure to be covered, for example the top deck of a boat, by threaded portion 114.

In accordance with the invention, marking device 112 includes a generally cylindrical socket portion 116 having an open end 118 and a closed end 120. Socket portion 116 is shaped complementary to stud 110 so that open end 118 fits snugly over stud 110. Socket portion 116 preferably includes means for releasably engaging the reduced-diameter section 111 of male lift-a-dot stud 110. In the embodiment shown in FIG. 4, the engaging means includes constriction 122, which snaps over the head portion of snap stud 10 and fits into section 111.

In accordance with the invention, marking device 112 also includes a pin portion 124 mounted on closed end 120 of socket portion 116 Pin portion 124 is capable of piercing the fabric cover when socket portion 116 is engaged with one of lift-a-dot studs 110.

Figure 6:
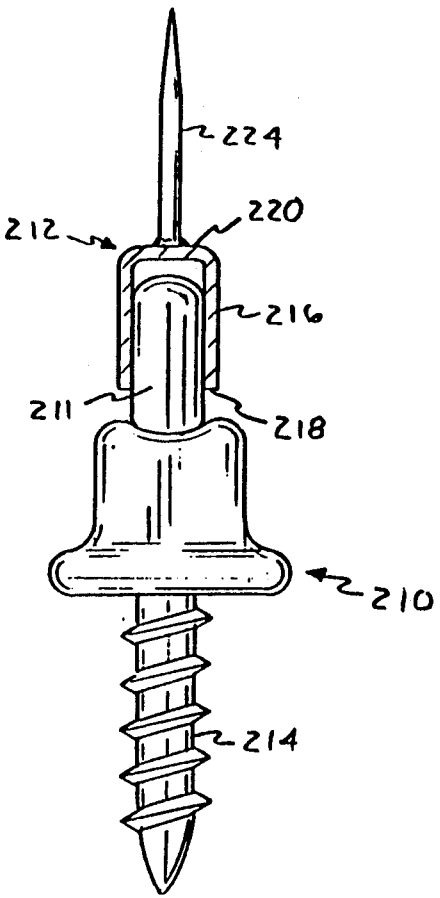
FIG. 6 is a partially cut away elevational view of the third embodiment of the fabric cover marking device of the present invention taken along lines 6—6 of FIG. 5.
Figure 5:
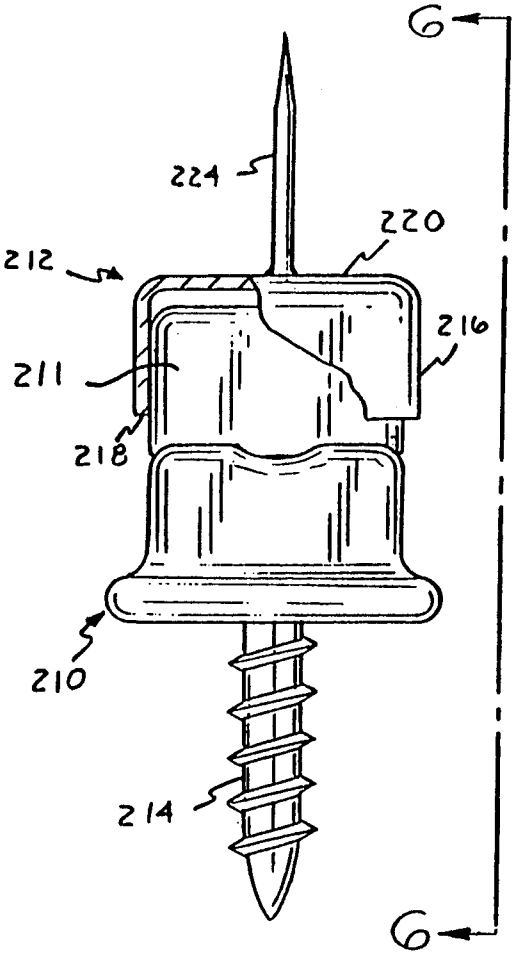
FIG. 5 is a partially cut away elevational view of a third embodiment of the fabric cover marking device of the present invention shown secured to a turnbuckle.

A third embodiment of the marking device of the present invention is shown in FIGS. 5 and 6. It is intended to be used for covers that are secured to the boat or other structures by turnbuckle fasteners. Specifically, the cover includes a plurality of female slot-shaped grommets that fit over turnbuckles 210. Each turnbuckle 210 includes a rotatable portion 211 that can be aligned with or rotated orthogonally to the base of turnbuckle 210. When portion 211 is aligned with the base, the grommet can be fit over the base of turnbuckle 210. By then rotating portion 211 orthogonal to the base, the grommet and cover are then secured to turnbuckle 210.

The third embodiment of the marking device, designated generally by reference numeral 212, is used to mark the locations on a fabric cover corresponding to the grommets that are to be removably secured to turnbuckles 210. Each turnbuckle 210 is secured to the structure to be covered, for example the top deck of a boat, by threaded portion 214.

In accordance with the invention, marking device 212 includes a generally rectangular cross-section socket portion 216 having an open end 218 and a closed end 220. Socket portion 216 is shaped complementary to portion 211 of turnbuckle 210 so that open end 218 fits snugly over portion 211.

In accordance with the invention, marking device 212 also includes a pin portion 224 mounted on closed end 220 of socket portion 216. Pin portion 224 is capable of piercing the fabric cover when socket portion 216 is engaged with one of turnbuckles 110.

It will be apparent to those skilled in the art that other modifications and variations can be made in the invention without departing from the scope of the invention. For example, the pin portion of the marking device can be bent or hinged to the socket portion so that the marking devices can be disengaged from the male fastener portions and remain attached to the fabric cover and thereby mark the locations for the female fastener portions until they are secured to the fabric. Although the method of the invention was described with specific reference to snap fasteners, it is equally applicable to covers secured by lift-a-dot fasteners and turnbuckles. In addition, the invention can be applied to male/female fastener devices other than snap fasteners, lift-a-dot fasteners, and turnbuckles. Moreover, although the invention has been described with reference to a cover for a motor boat, it can also be applied to covers for other structures, such as a cockpit cover for a sail boat or a cover for a truck bed or dump trailer. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. A device for marking the location of a female fastener portion on a fabric cover for a boat, the device comprising:

a socket portion complementary to and configured to be releasably engageable with a male fastener portion of the type for releasably securing a fabric cover to the boat; and a pin portion mounted on said socket portion, said pin portion being capable of marking the fabric cover at the location for the female fastener portion when said socket portion is engaged with the male fastener portion.

2. A device for marking the location of a female fastener portion on a fabric cover for a boat, the device comprising:

a socket portion complementary to and configured to be releasably engageable with a male fastener portion of the type for releasably securing a fabric cover to the boat; and a pin portion mounted on said socket portion, said pin portion being capable of marking the fabric cover by piercing the fabric cover at the location for the female fastener portion when said socket portion is engaged with the male fastener portion.

3. A device for marking the location on a fabric cover for a female lift-a-dot fastener portion engageable with a male lift-a-dot fastener portion mounted on a structure to be covered, the device comprising:

a generally cylindrical socket portion having an open end fitting over the top of the male lift-a-dot fastener portion and a closed end; and a pin portion fixed to said socket portion at said closed end thereof, said pin portion being capable of marking the fabric cover by piercing the fabric cover at the location for the female lift-a-dot fastener portion when said socket portion is engaged with the male fastener portion.

4. The device of claim 3, wherein said socket portion includes means for releasably engaging the male lift-a-dot fastener portion.

5. The device of claim 4, wherein said engaging means includes a constriction formed in said socket portion.

6. A device for marking the location on a fabric cover for a slot-shaped grommet engageable with a turnbuckle mounted on a structure to be covered, the device comprising:

a generally rectangular cross-section socket portion having an open end fitting over the top of the turnbuckle and a closed end; and a pin portion fixed to said socket portion at said closed end thereof, said pin portion being capable of marking the fabric cover by piercing the fabric cover at the location for the slot-shaped grommet when said socket portion is engaged with the turnbuckle.

7. A method for manufacturing a fabric cover for covering a structure having mounted thereon a plurality of male fastener portions to which the cover is to be fastened, the method comprising the steps of:

securing onto each of the male fastener portions a marking device comprising a socket portion complementary to the male fastener portion and having a pin portion mounted thereon;

disposing a fabric cover over the structure and over the marking devices secured to the male fastener portions;

piercing the fabric cover with the pin portions of the marking devices secured to the male fastener portions; and securing a female fastener portion to the fabric cover at each position where the fabric cover was pierced by one of the pin portions.

8. A method for manufacturing a fabric cover for covering a structure having mounted thereon a plurality of male fastener portions to which the cover is to be fastened, the method comprising the steps of:

securing onto each of the male fastener portions a marking device comprising a socket portion complementary to the male fastener portion and having a pin portion mounted thereon;

disposing the fabric cover over the structure and over the marking devices secured to the male fastener portions;

piercing the fabric cover with the pin portions of the marking devices secured to the male fastener portions; and marking the fabric cover at each of the locations where the fabric cover was pierced by one of the pin portions.

9. The method of claim 8, further comprising the step of securing a female fastener portion to the fabric cover at each location where the fabric cover is marked.

* * * * *